United States Patent [19]

Hidaka et al.

[11] Patent Number: 4,644,911

[45] Date of Patent: Feb. 24, 1987

[54] CYLINDER BLOCK FOR INTERNAL COMBUSTION ENGINE

[75] Inventors: Yoshiaki Hidaka; Junichi Araki, both of Saitama; Masayuki Tamura, Tokyo, all of Japan

[73] Assignee: Honda Giken Kogyo Kabushiki Kaisha, Tokyo, Japan

[21] Appl. No.: 657,685

[22] Filed: Oct. 4, 1984

[30] Foreign Application Priority Data

Oct. 7, 1983 [JP] Japan ..... 58-187790
Oct. 7, 1983 [JP] Japan ..... 58-187791

[51] Int. Cl.[4] ..... F02F 1/10

[52] U.S. Cl. ..... 123/52 M; 123/195 C; 123/195 H

[58] Field of Search ..... 123/52 M, 195 R, 195 C, 123/195 H

[56] References Cited

U.S. PATENT DOCUMENTS

| | | | |
|---|---|---|---|
| 1,299,709 | 4/1919 | Hall | 123/195 H |
| 3,367,311 | 2/1968 | Tenney | 123/52 M |
| 3,698,370 | 10/1972 | Haldeman et al. | 123/52 M |
| 4,117,823 | 10/1978 | Funabashi et al. | 123/195 C |
| 4,446,827 | 5/1984 | Kubozuka | 123/195 C |

*Primary Examiner*—Craig R. Feinberg
*Attorney, Agent, or Firm*—Lyon & Lyon

[57] ABSTRACT

A cylinder block for an internal combustion engine includes the skeleton frame formed of metal and a waterjacket surrounding the frame formed of a heat resistant plastic. The engine includes a cylinder head and the cylinder bearing supports and a sleeve forming a cylinder bore. The engine block, cylinder head and main bearings are fixed together with bolts which pass through portions of the framework parallel to the metal sleeve. The engine also includes an air intake pipe with the portion of the pipe adjacent the waterjacket integrally formed with the waterjacket.

18 Claims, 4 Drawing Figures

CYLINDER BLOCK FOR INTERNAL COMBUSTION ENGINE

In a vehicle such as an automobile, the ratio of the weight of an internal combustion engine to the total weight of the vehicle is high. Therefore, the reduction in the weight of the engine is an important factor to improve the performance of the vehicle. The prior art discloses reducing the weight of the engine by the use of a lightweight material such as a synthetic resin or ceramic. Japanese Utility Model No. 56-165932 discloses an internal combustion engine in which the water jacket outer wall and the skirt portion of a cylinder block are made of a synthetic resin. Japanese Utility Model No. 54-180823 discloses an internal combustion engine in which an intake pipe is made of a synthetic resin. Although these internal combustion engines use a lightweight material, their construction does not compensate for the lower strength and rigidity of the lightweight material. This may result in an undesirable warping of the engine components during use.

It is an object of the present invention to provide a novel internal combustion engine in which both a portion of a cylinder block and an air intake pipe are made of a heat-resisting synthetic resin. This permits reducing the weight of the engine while providing the necessary strength and rigidity. The use of the synthetic resin also provides a compact engine.

In the first embodiment of the internal combustion engine the cylinder block includes a square shaped skeleton frame made of metal; a cylinder sleeve made of metal for positioning a piston slidably therein, the cylinder sleeve being accommodated in the skeleton frame while leaving a clearance with said skelton frame; and an outer wall portion made of a heat resistant plastic and formed integrally to the frame in a manner to surround the outer periphery of the skeleton frame to form a water jacket between the outer portion and the cylinder sleeve for passing cooling water therethrough.

In a second form of the first embodiment the internal combustion engine includes a portion of the cylinder block and a portion of the intake pipe integrally formed of a heat-resisting synthetic resin material.

The present invention will be described in connection with a first and second embodiment of a two-cylinder engine shown in the accompanying drawings wherein.

In the internal combustion engine of the invention, the cylinder block 1, cylinder head 2 and crankcase 3 form an internal combustion engine E. The engine E which includes portions subject to a high temperature during engine operation as well as other portions required to provide strength and rigidity are made of cast iron. The portion forming the frame F of the cylinder block 1 and the cylinder sleeve 5 are also made of cast iron. The remaining portion of the engine E, which is subject to a relatively low temperature during engine operation, is made of a heat-resisting plastic such as a phenolic resin.

Figure 3:
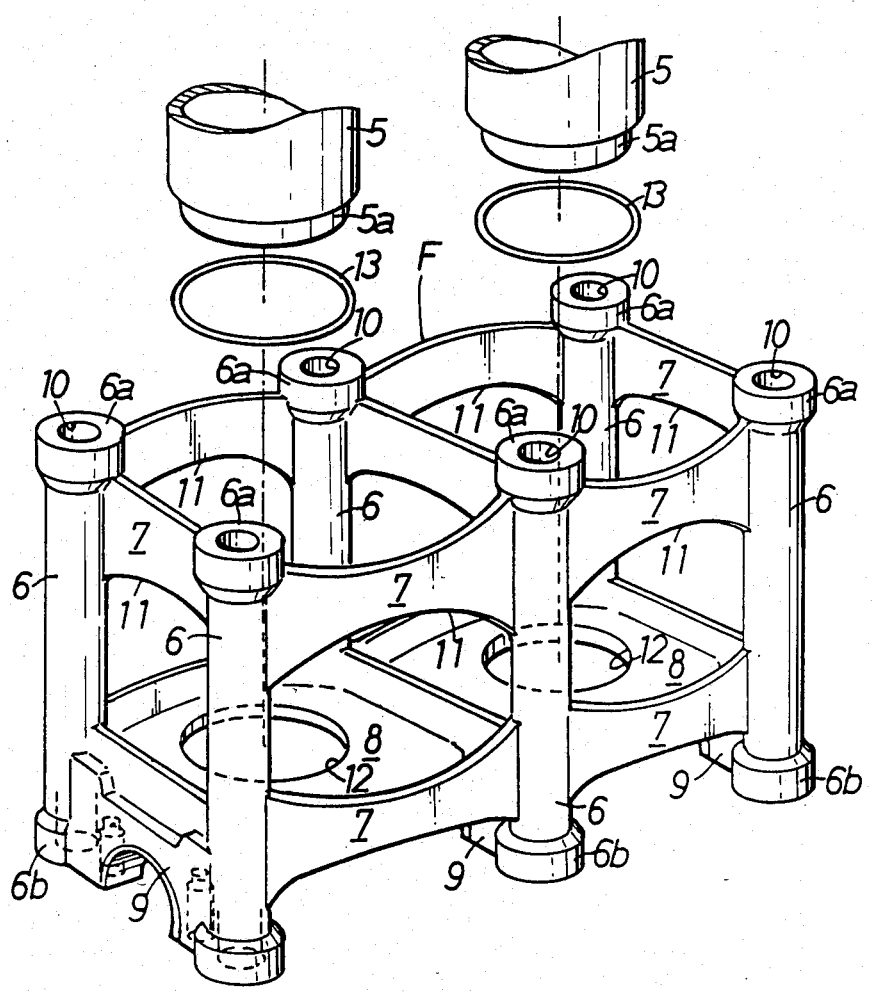
FIG. 3 is a perspective view of the engine frame and cylinder sleeve for the engine of FIG. 1.

The frame F of the cylinder block 1 is formed of cast iron in a square shape as shown in FIG. 3. The frame F includes (1) six posts 6 which are arranged at the individual corners of each engine cylinder, (2) rib plates 7 joining the sides of adjoining two of the posts 6, (3) a bottom wall 8 which covers the lower wall thereof, and (4) crankshaft bearing upper halves 9 which join the lower portions of adjoining posts 6.

Each of these posts 6 is formed into a column with bosses **6*c* and 6*b*. Each column has a central bolt hole 10 opening at the upper and lower end. Each of the rib plates 7 is formed at its central portion with an aperture 11 to reduce the total weight of the frame F. The bottom wall 8 of each engine cylinder is formed at its central portion with a hole 12 for sealably engaging the portion 5*a* of the cylinder sleeve 5 as will be described. The upper half 9** of the crankshaft bearing has an increased wall thickness to form a semi-circular bearing surface.

Figure 1:
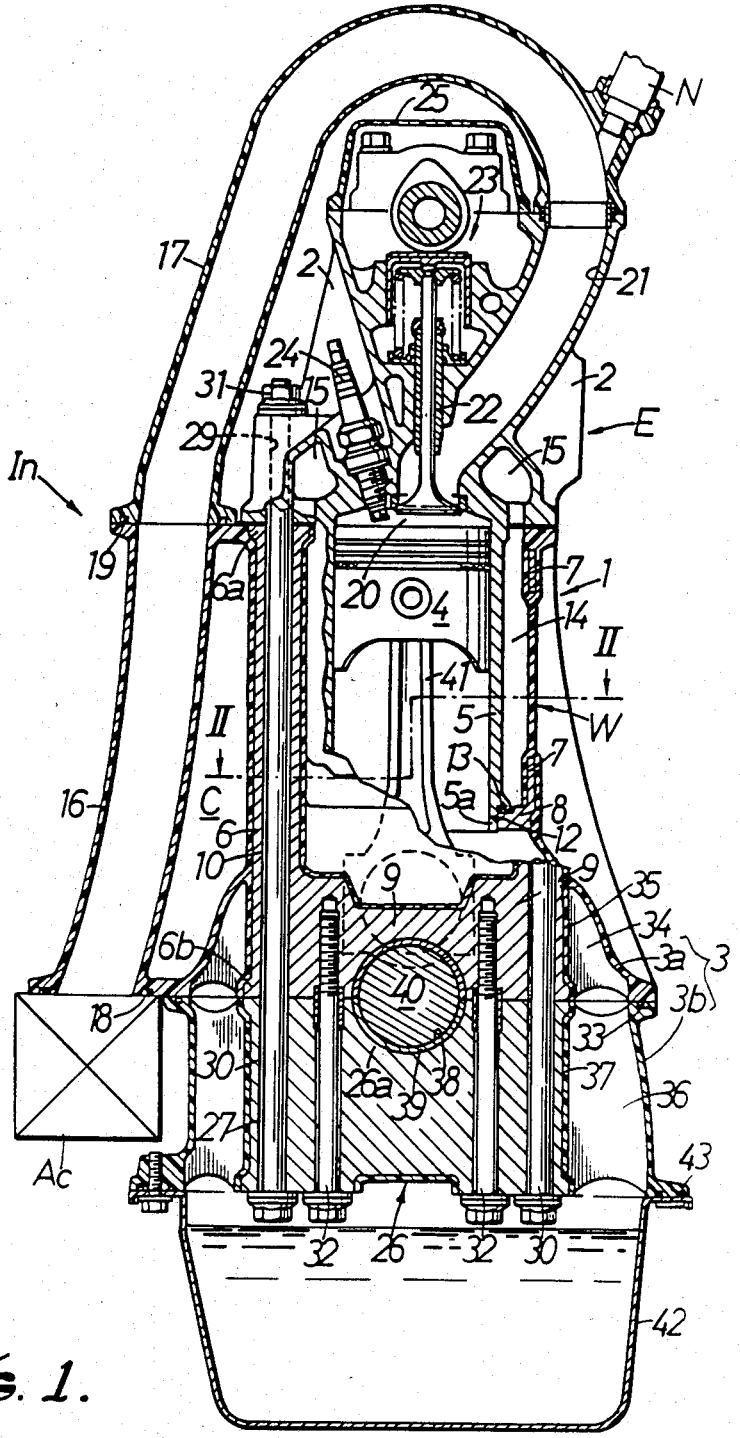
FIG. 1 is a transverse sectional view of an internal combustion engine showing a first embodiment of the invention.
Figure 2:
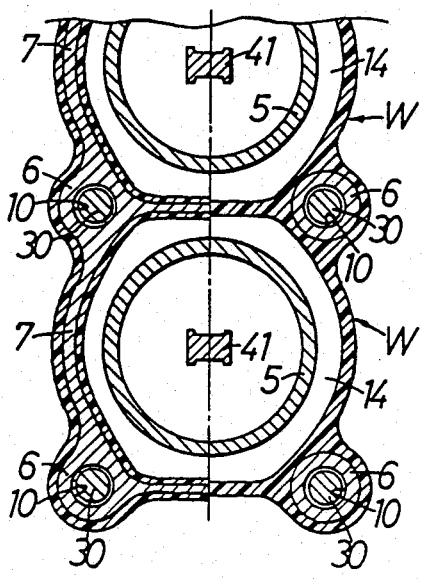
FIG. 2 is a cross-section on line II—II of the engine of FIG. 1.

The cylinder sleeve 5, which is made of cast iron, includes the end portion **5*a* as shown in FIG. 1. The end portion 5*a* includes a seal ring 13 which seals the sleeve in the hole 12 in the bottom wall 8**.

The posts 6 and the rib plates 7 of the frame F are cast integrally with an outer wall portion W of a heat resisting plastic such as a thermoset synthetic resin so that the apertures of the rib plates 7 are covered by the outer wall portion W. Between outer wall portion W and the cylinder sleeve 5 there is formed an annular water jacket 14 which has its upper end open to communicate with a water jacket 15 in the side of the cylinder head 2.

As shown in FIG. 1, the outer wall portion W which is made of the synthetic resin has its lower portion extending downward, while expanding sideward, to form an upper half **3*a* of the crankcase 3. There is integrally formed with this upper half portion 3*a* a rib member 34 and a cover wall 35 which covers the outer side of the crankshaft bearing upper half 9**.

At the left side of the outer wall portion W, as shown in FIG. 1, there is integrally formed a lower section 16 of the intake pipe In. The intake pipe In is spaced at a clearance C from the outer wall W. An air cleaner Ac is connected through a seal ring 18 to the open lower end of the lower section 16.

The cylinder head 2, formed of cast iron, includes an intake port 21 which connects to a combustion chamber 20.

The open upper end of the intake port 21 is connected to the open end of the upper section 17 of the intake pipe In. The upper section In is made of a heat resisting plastic such as a thermoset synthetic resin. The open upper end of the upper section 17 of the intake pipe In connects through a seal ring 19 to the intake port 21. The upper section 17 of the intake pipe In is curved to a loop over the cylinder head 2 as shown in FIG. 1. The open lower end of the upper section 17 connects to the lower portion 16 of the intake pipe In as previously described. The looped shape of the upper section 17 of the intake pipe In also contributes to making the internal combustion engine compact in size.

The cylinder head 2 includes, an intake valve 22 for opening and closing the intake port 21, a valve actuating mechanism 23 for operating the intake valve 22, and an ignition plug 24. A fuel injection nozzle N is positioned in the intake port 21 of the upper section 17 of the intake pipe In. The cylinder head 2 also includes an exhaust port (not shown) parallel with the intake port 21, an exhaust valve (not shown) for opening and closing the exhaust port, and a valve actuating mechanism (not shown) for operating the exhaust valve. A head cover 25 made of a thermoset synthetic resin encloses the valve actuating mechanism.

Referring to FIG. 1 the frame F, made of cast iron, has a crankshaft bearing block 26. The crankshaft bearing block 26, the cylinder block 1 and the cylinder head 2 are held clamped together with bolts 30 and nuts 31. The bolts 30 are inserted through the bolt holes 27 formed in the crankshaft bearing block 26, through the bolt holes 10 formed in the posts 6 of the frame F, and through the bolt holes 29 formed in the cylinder head 2. This provides strength and rigidity in the engine.

The crankshaft bearing block 26 is formed with a plurality of crankshaft bearing lower halves 26*a* which match the crankshaft bearing upper halves 9 formed in the frame F. The crankshaft bearing lower halves 26*a* are also each attached to the corresponding crankshaft bearing upper halves 9 with the two bolts 32. This provides further strength to the engine.

The crankcase upper half 3*a*, formed of thermoset synthetic resin, is attached through a seal ring 33 to a crankcase lower half 3*b* which is also formed of thermoset synthetic resin. The crankcase lower half 3*b* includes a cover wall 37 extending through rib members 36 into the crankcase 3. The cover wall 37 covers the outer periphery and lower face of the crankshaft bearing block 26. A crankshaft 40 is rotatably supported in the bearing block 26. The bearing block 26 includes a bearing 39 forming a bearing hole 38. A connecting rod 41 attaches the crank of the crankshaft 40 to the piston 4 which is slidably positioned in the cylinder sleeve 5. An oil pan 42 made of a steel plate is attached to the crankcase lower half 3*b* through a seal ring 43.

With the exception of the frame F and the cylinder sleeve 5, the remaining portions of the cylinder block 1 of the engine and the intake pipe In are made of a heat-resistant plastic such as a thermoset synthetic resin to reduce the total weight of the engine. The use of the square-shape frame F for the cylinder block 1 provides sufficient strength for engine operation while providing weight reduction. Heat resistant plastic is used for the outer wall portion W since it is not heated to a high temperature and is cooled by the cooling water flowing through the water jacket 14. The outer wall portion W of the cylinder block 1 is not heated to a high temperature therefore the heat resistant plastic provides strength and rigidity. The intake pipe In is cooled by the intake air therefore, the heat resistant plastic provides strength and rigidity.

Figure 4:
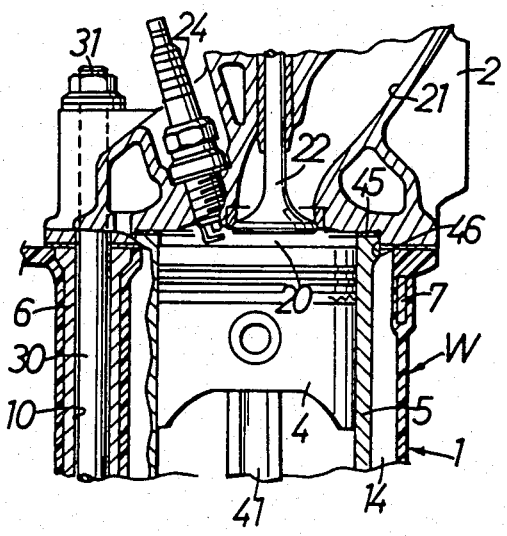
FIG. 4 is a partial cross-sectional view of an internal combustion engine similar to FIG. 1 showing a second embodiment of the invention.

FIG. 4 shows a second embodiment of the present invention. In this embodiment the cylinder sleeve 5 is made separate from the cylinder head 2. The upper part of the cylinder sleeve 5 fits into a recess 46 formed in the lower face of the cylinder head 2. The cylinder head 2 and cylinder sleeve are sealed by a gasket 45.

The internal combustion engine of the invention provides an unique construction of the cylinder block. The cylinder block is formed with a skeleton frame made of metal and an outer wall portion made of a heat resistant plastic. A water jacket is formed between the outer wall and the cylinder sleeve for passing cooling water therethrough. This permits forming a major part of the cylinder block from a heat resistant plastic having a low specific weight which substantially reduces the total weight of the internal combustion engine.

In addition by forming the skeleton frame of metal a square shape to surround the cylinder sleeve of metal, strength and rigidity are provided to compensate for the use of a heat resistant plastic for the outer wall. The novel cylinder block has its weight substantially reduced while retaining the desired physical properties such as strength, heat resistance, wear resistance and impact resistance. This provides an engine which is highly desirable for use in a vehicle.

In the second form of the first embodiment the internal combustion engine of the invention includes an integral construction of a portion of the cylinder block and a portion of the intake pipe with a heat-resistant synthetic resin material. This provides a further reduction in the weight of the engine. The integral construction of the intake pipe with the cylinder block provides a reinforcement which increases their strength and rigidity. Also, the integral construction eliminates the need for attaching the intake pipe to the engine thereby narrowing the engine width.

In addition, forming the intake pipe of a synthetic resin improves vibration absorptivity over the prior metal intake pipe. This permits lengthening the intake pipe while continuing to achieve an improved vibration absorptivity.

The invention claimed is:

1. A cylinder block for an internal combustion engine, comprising: a square-shaped skeleton frame made of metal having four sides each containing a substantial void therein, and a bottom member joining said sides; a cylinder sleeve made of metal for positioning a piston slidably therein and having an outer periphery, said cylinder sleeve being accommodated in said skeleton frame while leaving a clearance between said outer periphery and said sides of said skeleton frame; and an outer wall portion made of a heat resisting plastic and formed integrally to all exposed surfaces of said skeleton frame but the bottom member, and extending over said voids in a manner to surround the exposed surfaces and voids on the sides of said skeleton frame to form a water jacket between said outer wall portion and said cylinder sleeve for passing cooling water therethrough.

2. The cylinder block for the internal combustion engine set forth in claim 1 wherein said metal skeleton frame is formed with a plurality of posts arranged spaced around the outer periphery of said cylinder sleeve; rib plates joining said posts; and said bottom member comprising a bottom plate covering a bottom surface of said frame formed with an opening for sealably mounting said cylinder sleeve.

3. A cylinder block for the internal combustion engine set forth in claim 1 wherein said cylinder sleeve is made integral with a cylinder head.

4. A cylinder block for the internal combustion engine set forth in claim 1 wherein said cylinder sleeve includes a surface for sealably mounting in said cylinder head.

5. A cylinder block for an internal combustion engine having at least one cylinder comprising, an integral metal skeleton frame having a plurality of posts extending from a lower wall parallel to and spaced around each cylinder, said skeleton frame including integral rib means extending between and joining said posts, said skeleton frame having substantial sized aperatures formed between each pair of adjacent posts and each pair of adjacent said rib means, heat-resistant plastic means integrally formed on faces but the lower wall of said skeleton frame for producing a unitary frame having plastic wall portions closing said aperatures, a separate cylinder sleeve positioned in said unitary frame for each cylinder and having an outer surface spaced from said unitary frame for forming a cooling water jacket between each said sleeve and said unitary frame.

6. The cylinder block of claim 5, wherein each post has a bore therethrough for receiving a bolt for connecting a cylinder head to said cylinder block.

7. The cylinder block of claim 5, wherein each pair of spaced rib means extends between each pair of posts and forms said aperature therebetween.

8. The cylinder block of claim 5, wherein said metal skeleton frame is substantially encapsulated in said heat-resistant plastic.

9. The cylinder block of claim 5, wherein said posts and rib means are substantially completely covered by said heat-resistant plastic.

10. The cylinder block of claim 5, wherein each said cylinder sleeve is removably mounted in said unitary frame.

11. The cylinder block of claim 10, wherein said lower wall has a hole therein for receiving and supporting each said cylinder sleeve.

12. A cylinder block for an internal combustion engine set forth in claim 1 wherein said cylinder block having a crankshaft bearing means, and at least four bolt means passing through portions of said frame parallel to said sleeve to rigidly interconnect said cylinder head, said frame and said crankshaft bearing means.

13. The engine defined in claim 12 wherein said cylinder sleeve and said frame include mating surfaces for sealably mounting said sleeve.

14. The engine defined in claim 12 wherein said cylinder sleeve is formed integral with said cylinder head.

15. The engine defined in claim 12 wherein said crankshaft bearing means is a split bearing for assembly of a crankshaft.

16. The engine defined in claim 12 wherein said frame includes at least four structural bosses spaced around said cylinder sleeve, each boss having a hole for receiving one of said bolt means.

17. The engine defined in claim 12 wherein said engine further includes an air intake pipe means, said air intake pipe means positioned adjacent said cylinder block and integrally formed of a heat resistant plastic integral with said water cooling jacket.

18. The engine defined in claim 12 wherein said water cooling jacket and said frame form an engine block.

* * * * *